US007484629B2

(12) United States Patent
Cottrell

(10) Patent No.: US 7,484,629 B2
(45) Date of Patent: Feb. 3, 2009

(54) SANITIZING TOOTHBRUSH HOLDER

(76) Inventor: Carolyn Cottrell, 11 Catesby La., Bedford, NH (US) 03110

( * ) Notice: Subject to any disclaimer, the term of this patent is extended or adjusted under 35 U.S.C. 154(b) by 474 days.

(21) Appl. No.: 11/162,415

(22) Filed: Sep. 9, 2005

(65) Prior Publication Data

US 2007/0056864 A1 Mar. 15, 2007

(51) Int. Cl.
*A47B 81/02* (2006.01)

(52) U.S. Cl. ..... 211/65; 211/41.9; 211/60.1; 206/361; 206/362; 206/362.2; 248/110

(58) Field of Classification Search ..... 206/361, 206/362, 362.1, 362.2, 362.3, 15.2, 15.3, 206/209, 209.1; 211/65, 66, 41.9, 85.13, 211/60.1, 70.6, 119.009; 248/110
See application file for complete search history.

(56) References Cited

U.S. PATENT DOCUMENTS

| | | | | | |
|---|---|---|---|---|---|
| 2,117,459 | A * | 5/1938 | Stanton | 211/65 |
| D111,410 | S * | 9/1938 | Stanton | D6/534 |
| 2,608,294 | A * | 8/1952 | Ward | 206/362.1 |
| 3,881,868 | A * | 5/1975 | Duke | 206/209.1 |
| 5,297,677 | A * | 3/1994 | Burian et al. | 206/362.4 |
| 5,769,245 | A * | 6/1998 | Butler | 211/65 |
| 6,186,324 | B1 * | 2/2001 | Catterson | 206/362.1 |
| 6,935,515 | B1 * | 8/2005 | Sookoo | 211/65 |
| 2005/0035072 | A1 * | 2/2005 | Tayebi | 211/65 |

* cited by examiner

*Primary Examiner*—David Fidei
(74) *Attorney, Agent, or Firm*—Joseph E. Funk

(57) ABSTRACT

A sanitizing toothbrush holder is described for sanitizing one or more toothbrushes in a household dishwasher. The holder is designed so as to fit in a space in the dishwasher rack used typically for holding a dinner plate, and has one or more holes in a top surface sized so as to pass a toothbrush handle but not a toothbrush head.

7 Claims, 4 Drawing Sheets

SANITIZING TOOTHBRUSH HOLDER

TECHNICAL FIELD

This invention relates to dentistry, and more particularly to oral hygiene and reinfection due to contamination of toothbrushes.

BACKGROUND INFORMATION

It has been known in the dental profession since at least as early as the 1920's that a toothbrush is a potential source of cross-infection if shared, and re-infection even if not shared. Germs and viruses contaminating the toothbrush from exposure to the mouth and teeth thrive in the warm and moist environment found in most bathrooms.

Toxin-producing bacterial growth along the gum line is associated with gingivitis as well as acid-induced dental caries. The Centers for Disease Control suggests that toothbrushes can harbor pathogenic organisms even after being rinsed visibly clean. Toothbrushes can contain bacteria and viruses that cause cross-infection between brushes and re-infection during illness. This is most hazardous to those individuals with periodontal disease or compromised immune systems.

Simply rinsing a toothbrush in clean water does not substantially reduce the number of pathogenic organisms as those remaining quickly grow back. Methods such as rinsing the brush in a mouthwash can reduce contamination by as much as 99%, which sounds good until one realizes that the remaining one percent can number in the tens of thousands and can multiply rapidly.

Other methods to sterilize toothbrushes have been tried. For example, autoclaving a toothbrush can result in sterilization of the brush, but damages most modern toothbrush plastics and the cost and inconvenience of autoclaving is such as to discourage the average consumer. Exposure of the brush to ultra-violet light is another method that has been effective, although again such devices are not inexpensive. Microwaving toothbrushes is effective in killing pathogens but takes 10 minutes at full power. This method produces a melted down toothbrush and therefore is ineffective. After a period of time Ultraviolet light loses its energy levels as it continues to bounce around the cylinder and becomes less effective in its ability to sanitize. Sanitation by steam in a closed contained can allow pathogens to grow in the lower part of the chamber where moisture collects, and pathogens can re-infect.

Washing a toothbrush in a dishwasher has been shown to be an effective way of sanitization, but the potential exists for cross-contamination from other brushes and from utensils if the utensil basket is used to hold the brushes. It was found too that the toothbrush could be ejected from the of the utensil basket.

What is needed is a simple, inexpensive and effective way to sanitize a toothbrush while not damaging the bristles or handle in the process. It would also be beneficial to have a way to expose more of the toothbrush, including the handle, to the sanitizing wash than is provided by a utensil basket.

SUMMARY

The solution is a sanitizing toothbrush holder designed to hold one or more toothbrushes in the rack of a conventional dishwasher. The brushes are separated sufficiently to minimize cross contamination. Thus the brushes are isolated, yet exposed to the full washing cycle of the dishwasher. The holder is designed so as to fit in a space between tines of a dishwasher rack, such as a space used for a dinner plate.

It has been shown that cleaning a toothbrush in such a holder in a normal household dishwasher can sterilize the brush without causing damage either to the bristles or the handle. The dishwashing method has been shown to be at least, if not substantially more, effective than other methods such as rinsing, exposure to ultraviolet light or soaking in a mouthwash, and quite inexpensively.

In one embodiment, the invention has a top surface connected to a lower surface by a vertical support member. The top surface has one or more holes designed to pass a toothbrush handle but not the head. The lower surface has one or more holes designed to receive a toothbrush handle and to increase water flow.

In another embodiment, the sanitizing toothbrush holder has one or more slots or slotted tabs extending outwardly and substantially horizontally from the holder and designed to go over one or more dishwasher rack tines. This has the benefit of holding the sanitizing toothbrush holder in place and providing additional support.

DETAILED DESCRIPTION

Figure 1A:
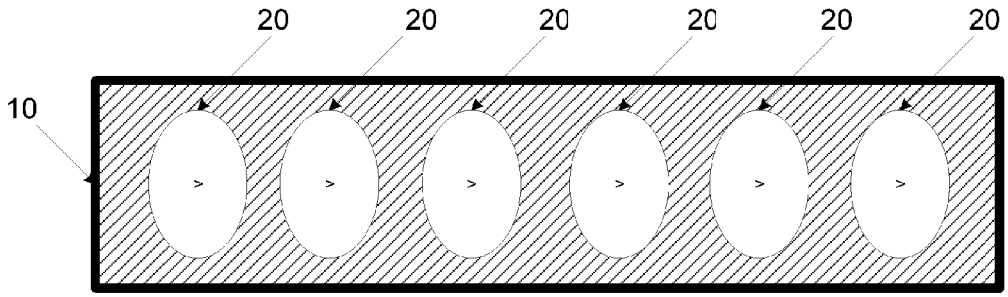
FIGS. 1A, 1B and 1C are top, side and bottom view of a sanitizing toothbrush holder.
Figure 1B:
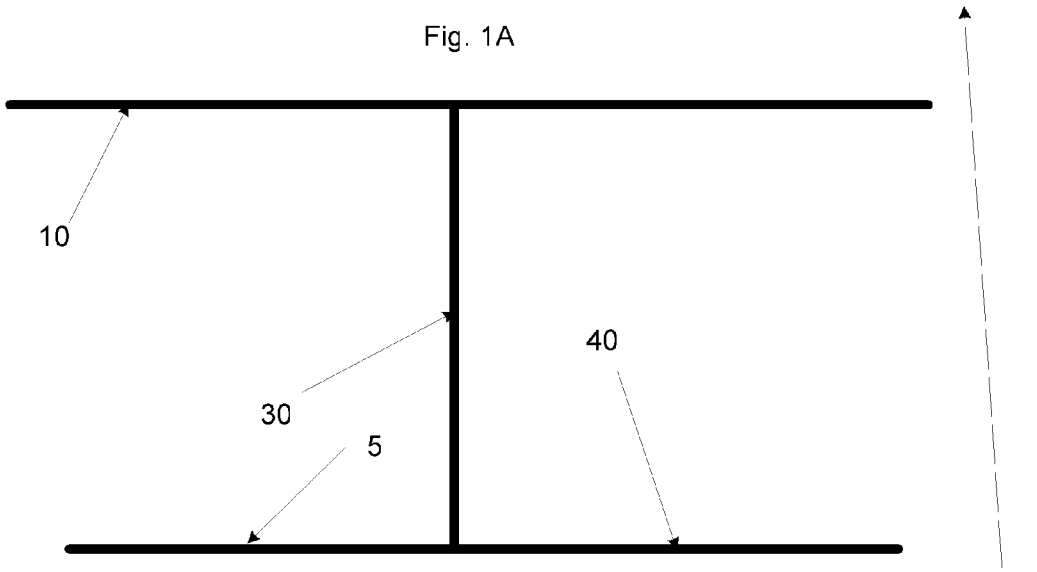
Figure 1C:
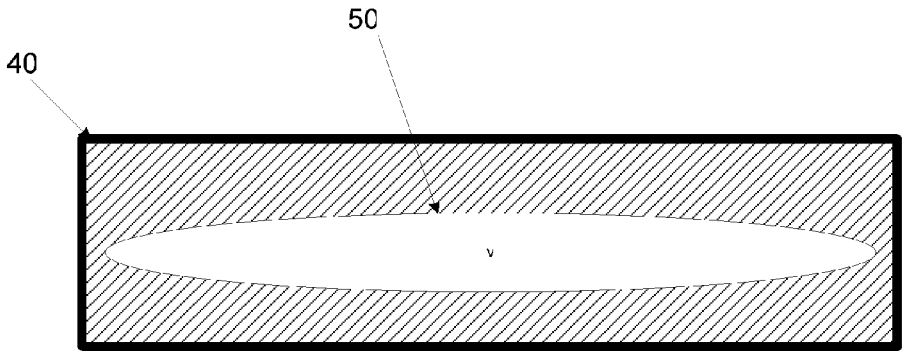

Referring to FIGS. 1A, 1B and 1C, a sanitizing toothbrush holder 5 for use in a household dishwasher is shown, in accordance with the principles of the invention. An upper surface 10 has one or more holes 20 into which a toothbrush handle may pass, but sized so as not to allow the passage of the head of a toothbrush (not shown). The entire sanitizing toothbrush holder 5 should be sized so as to fit between the tines of a dishwasher rack such as a space wherein a dinner plate might be placed.

Figure 4:
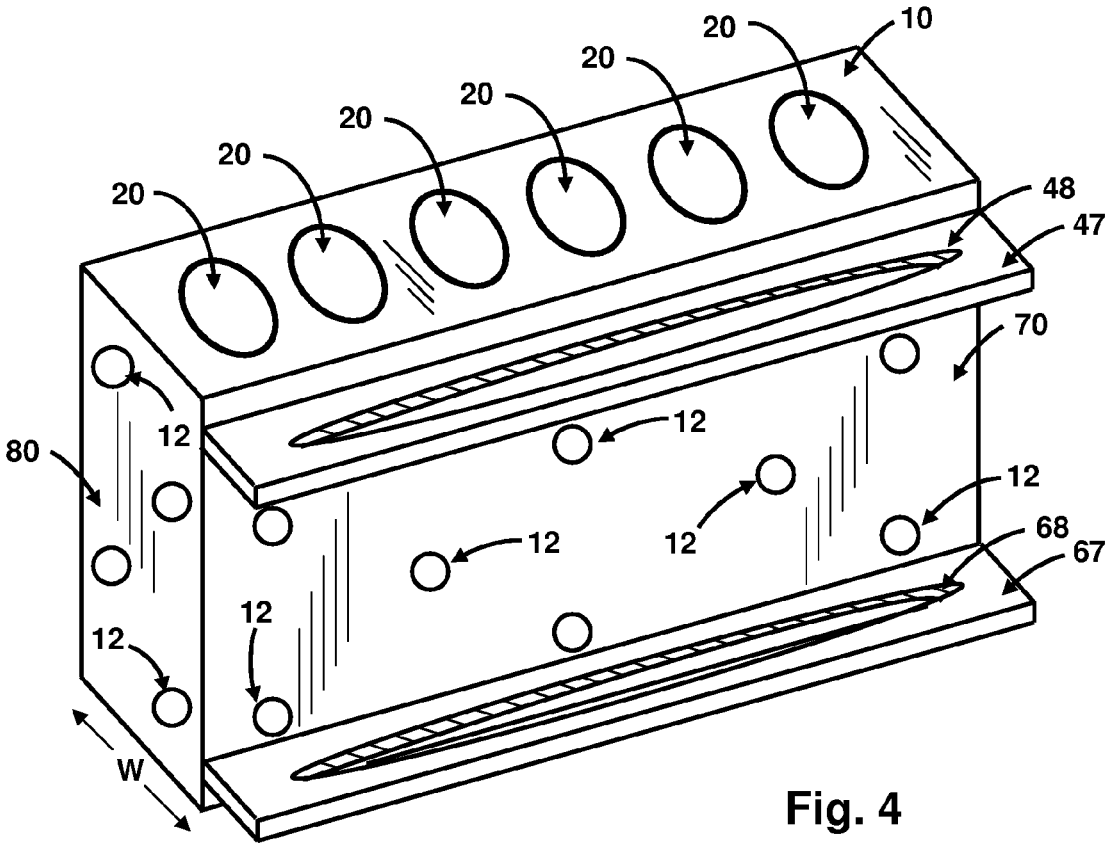
FIG. 4 is a three dimensional view of a sanitizing toothbrush holder having enclosed sides with holes there through for escape of water and debris, and having the upper and lower slots of FIG. 2 for mounting the toothbrush holder to tines of a dishwasher rack.

The sanitizing toothbrush holder 5 has a vertical support member 30 which connects the upper surface 10 with a lower surface 40. Placement and shape of the support member 30 is not critical, provided that the vertical support member 30 is of such a length as to provide space between the upper surface 10 and the lower surface 40 approximately the length of a toothbrush handle. The vertical support member 30 may also be in the form of a basket connecting the four sides of the upper surface 10 with the four sides of the lower surface 40 although such a configuration lessens the flow of water around the toothbrush handles. As shown in FIG. 4 the basket has two long sides 70, front and back but the back side is not seen, and two short sides 80, left and right but the right side is not seen, each of the four sides having a plurality of holes 12 there through to allow the passage of water and debris.

The upper surface holes 20 are preferably spaced sufficiently apart so as to prevent one toothbrush head from touching another toothbrush head. This has the effect of minimizing cross-contamination between brushes.

The bottom surface 40 may be fitted with a groove, or in a preferred embodiment with one or more lower surface holes 50 sized so as to be able to receive a toothbrush handle. Having a hole rather than a groove increases the flow of water across the toothbrush and prevents pooling.

The sanitizing toothbrush holder 5 may be made of any number of suitable materials designed to be utilized in a dishwasher environment, such as stainless steel or plastic. It is important that whatever material is used be such as to withstand the temperatures both of the water during washing and during the drying cycle.

Figure 2A:
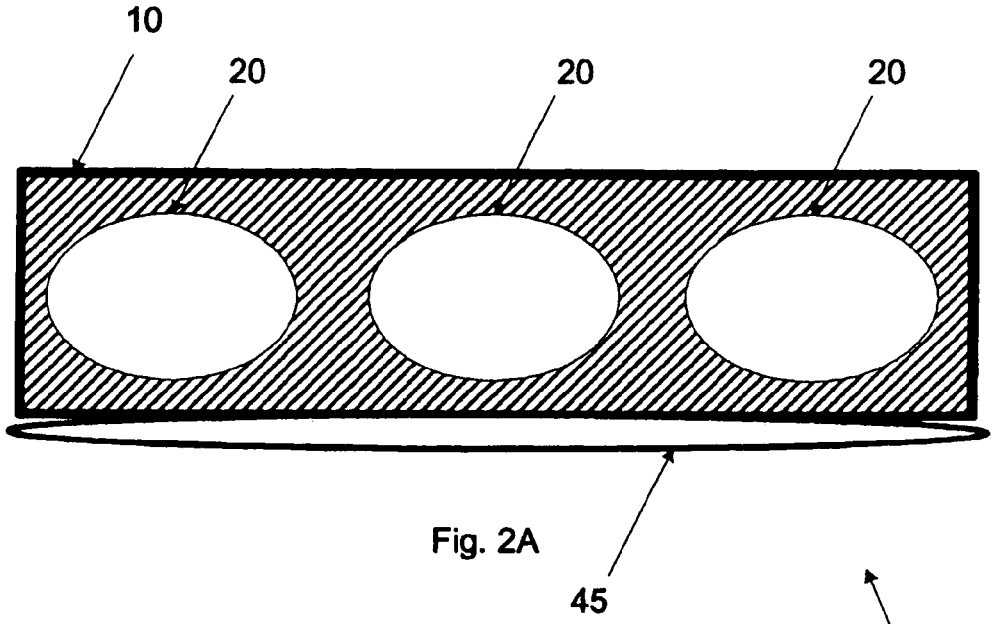
FIGS. 2A and 2B are top and bottom views respectively of another embodiment of a sanitizing toothbrush holder.
Figure 2B:
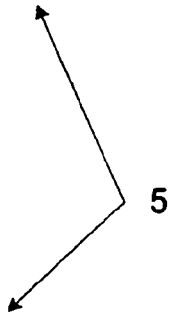
Figure 2B:
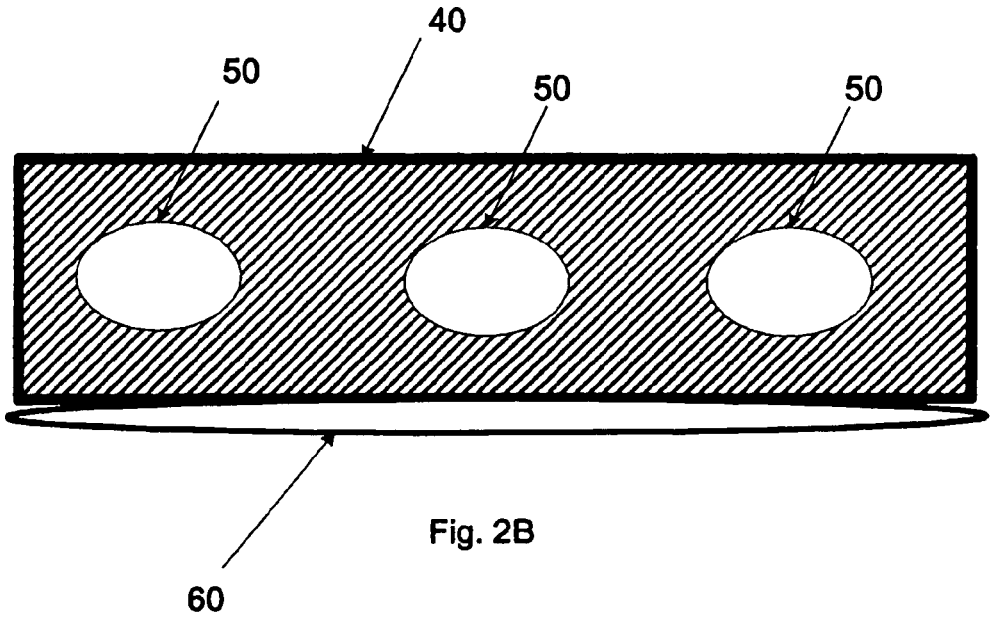

FIGS. 2A and 2B show another embodiment of a sanitizing toothbrush holder having an upper slot 45 through an extension protruding from one edge 15 of the upper surface 10. The upper slot may be placed over one or more tines of the dishwasher rack (not sown) so as to help stabilize the sanitizing toothbrush holder 5 and to hold it in place. The slot is preferably sized so as to be able to accommodate at least two tines of the dishwasher rack. It is also preferable to have the upper slot 45 and the lower slot 60 extend away from the upper surface 10 and lower surface 40 so as to have the sanitizing toothbrush holder 5 fit within the interstices between the dishwasher rack designed to hold such items as a dinner plate. Further stabilization may be obtained by having a lower slot 60 through an extension protruding from one edge 17 of the lower surface 40 which may also beneficially be placed over one or more tines of the dishwasher rack.

In the embodiment shown, instead of the single lower surface hole shown in FIG. 1C, a multiplicity of lower surface holes 50 are utilized.

Figure 3A:
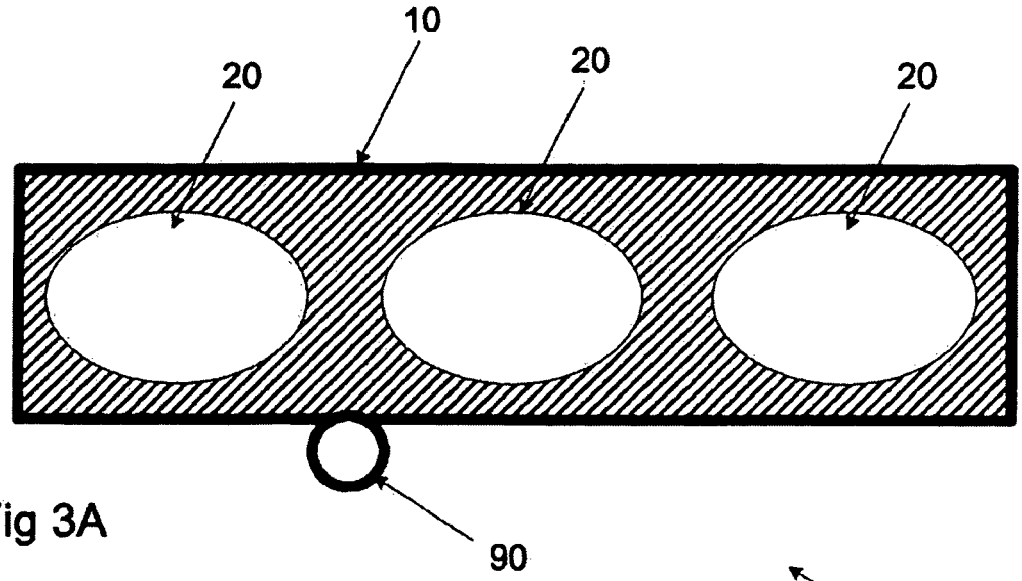
FIGS. 3A and 3B are top and bottom views respectively of yet another embodiment of a sanitizing toothbrush holder.
Figure 3B:
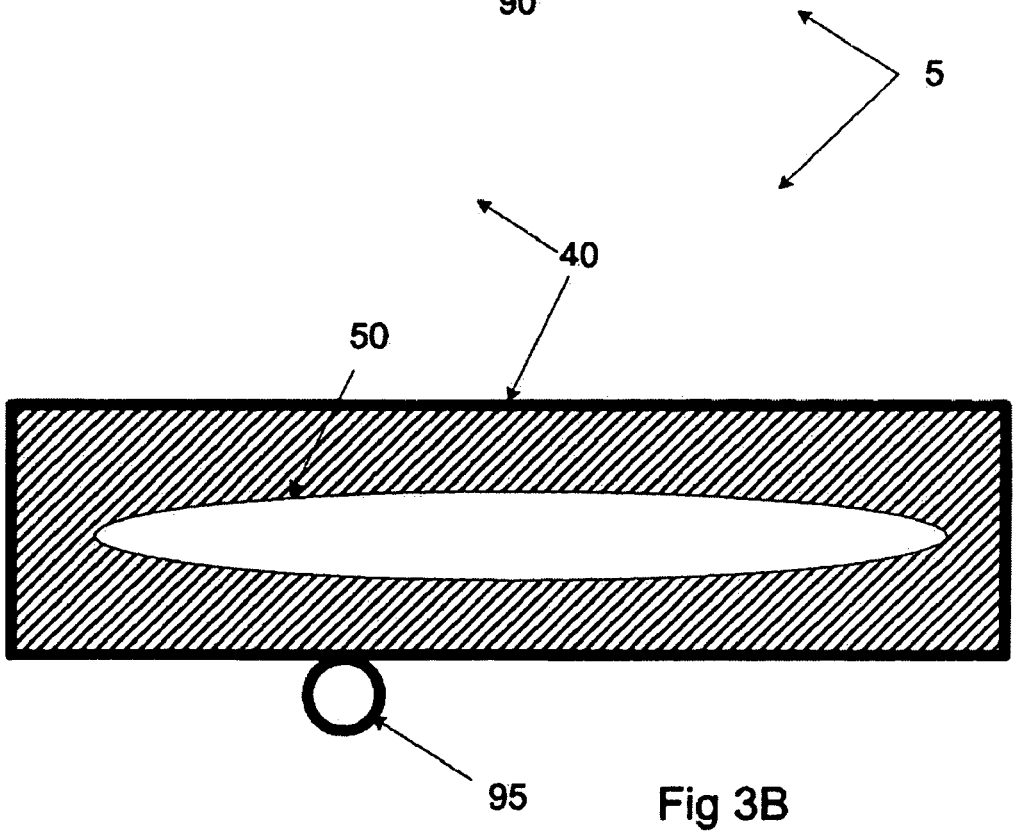

Yet another embodiment of a sanitizing toothbrush holder is shown in FIGS. 3A and 3B. Instead of the upper surface slot 45 and lower surface slot 60 a single upper tine hole 90 is provided. A lower tine hole 95 may also beneficially be used.

Yet another embodiment of the invention is shown in FIG. 4. In this embodiment there is no vertical support member 30. Rather, the vertical support is provided by a basket connecting the four sides of the upper surface 10 with the four sides of the lower surface 40. As shown the basket has two long sides 70 and two short sides 80 each having a plurality of holes 12 there through to allow the passage of water and debris. Tab 47 with an elongated oval shaped slot 48 there through extends substantially horizontally from side 70 of the basket near top surface 10. Likewise, tab 67 with an elongated oval shaped slot 68 there through extends substantially horizontally from side 70 of the basket near bottom surface 40.

What is claimed is:

1. A sanitizing toothbrush holder for holding toothbrushes during sanitization, the toothbrushes each having a head and a handle, the toothbrush holder comprising:

an upper surface having a bottom side and having at least one opening through the upper surface that is of a size so as to be able to receive and hold in place a toothbrush handle and further being smaller than the head of a toothbrush;

at least one vertical support member having a top end and a bottom end and attached at said top end to said bottom side of said upper surface;

a lower surface attached to said bottom end of said at least one vertical support member, said lower surface comprising at least one lower hole oriented substantially parallel to said upper surface, the handle of a toothbrush that has been inserted through said at least one opening of said upper surface passing through said at least one lower hole; and at least one slotted tab protruding from a side of the sanitizing toothbrush holder, the slot of the tab being placed over a tine in a dishwasher rack during use of the sanitizing toothbrush holder.

2. The sanitizing toothbrush holder of claim 1 wherein the upper surface comprises an upper surface edge, and wherein the at least one slotted tab protruding from a side of the sanitizing toothbrush holder protrudes from said upper surface edge and is substantially parallel to said upper surface.

3. The sanitizing toothbrush holder of claim 1 further wherein the at least one slotted tab protruding from a side of the sanitizing toothbrush holder protrudes from said vertical support member.

4. The sanitizing toothbrush holder of claim 1 wherein said lower surface comprises a lower surface edge, and wherein the at least one slotted tab protruding from a side of the sanitizing toothbrush holder protrudes from said lower surface edge and is substantially parallel to said upper surface.

5. The sanitizing toothbrush holder of claim 1 further comprising at least one tab substantially parallel to said upper surface and situated on said at least one vertical support member and extending outwardly and substantially perpendicular to said at least one vertical support member, and further comprising a tab hole in said tab, said tab hole capable of receiving at least one tine from a dishwasher rack.

6. The sanitizing toothbrush holder of claim 1 further comprising a basket abutting the sides of the upper and lower surface and having a plurality of holes there through to allow the passage of water and debris, said basket being of a size so as to fit between tines of a dishwasher rack.

7. The sanitizing toothbrush holder of claim 6 wherein said basket further comprises at least one slotted tab protruding substantially horizontally from the basket, said at least one slotted tab sized so as to be able to receive at least one tine from a dishwasher rack.

* * * * *